US006017668A

United States Patent [19]

Young et al.

[11] Patent Number: 6,017,668

[45] Date of Patent: Jan. 25, 2000

[54] TONER COMPOSITIONS

[75] Inventors: Eugene F. Young, Rochester; Robert L. Lohr, Fairport; Christine C. Lyons, Rochester, all of N.Y.; Lauro D. Andrade, Bahia, Brazil

[73] Assignee: Xerox Corporation, Stamford, Conn.

[21] Appl. No.: 09/320,641

[22] Filed: May 26, 1999

[51] Int. Cl.[7] ..... G03G 9/083

[52] U.S. Cl. ..... 430/106.6; 430/110; 430/111

[58] Field of Search ..... 430/106.6, 110, 430/111

[56] References Cited

U.S. PATENT DOCUMENTS

| | | | |
|---|---|---|---|
| 2,986,521 | 5/1961 | Wielicki | 430/110 |
| 3,590,000 | 6/1971 | Palermiti et al. | 430/110 |
| 3,893,935 | 7/1975 | Jadwin et al. | 430/110 |
| 3,900,588 | 8/1975 | Fisher | 430/110 |
| 3,944,493 | 3/1976 | Jadwin et al. | 430/110 |
| 4,007,293 | 2/1977 | Mincer et al. | 430/108 |
| 4,079,014 | 3/1978 | Burness et al. | 430/110 |
| 4,206,064 | 6/1980 | Kiuchi et al. | 430/106 |
| 4,221,856 | 9/1980 | Lu | 430/101 |
| 4,265,990 | 5/1981 | Stolka et al. | 430/59 |
| 4,291,111 | 9/1981 | Lu | 430/107 |
| 4,298,672 | 11/1981 | Lu | 430/108 |
| 4,338,390 | 7/1982 | Lu | 430/106 |
| 4,394,430 | 7/1983 | Jadwin et al. | 430/110 |
| 4,404,271 | 9/1983 | Kawagishi et al. | 430/110 |
| 4,411,974 | 10/1983 | Lu et al. | 430/106 |
| 4,433,040 | 2/1984 | Niimura et al. | 430/109 |
| 4,558,108 | 12/1985 | Alexandru et al. | 526/340 |
| 4,560,635 | 12/1985 | Hoffend et al. | 430/106.6 |
| 4,585,884 | 4/1986 | Lin et al. | 556/413 |
| 4,859,550 | 8/1989 | Gruber et al. | 430/39 |
| 4,917,982 | 4/1990 | Tomono et al. | 430/99 |
| 4,921,771 | 5/1990 | Tomnono et al. | 430/110 |
| 4,935,326 | 6/1990 | Creatura et al. | 430/108 |
| 4,937,166 | 6/1990 | Creatura et al. | 430/108 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,045,423 | 9/1991 | Weber et al. | 430/110 |
| 5,223,368 | 6/1993 | Ciccarelli et al. | 430/110 |
| 5,304,449 | 4/1994 | Hollenbaugh, Jr. | 430/110 |
| 5,376,494 | 12/1994 | Mahabadi et al. | 430/137 |
| 5,482,805 | 1/1996 | Grande et al. | 430/106 |
| 5,486,443 | 1/1996 | Grande et al. | 430/106.6 |
| 5,487,841 | 1/1996 | Young et al. | 252/62.59 |
| 5,510,221 | 4/1996 | Matalevich et al. | 430/106.6 |
| 5,512,406 | 4/1996 | Takeda et al. | 430/110 |
| 5,641,601 | 6/1997 | Mitani et al. | 430/111 |
| 5,648,539 | 7/1997 | Goodbrand | 564/309 |
| 5,648,542 | 7/1997 | Goodbrand et al. | 564/405 |

*Primary Examiner*—Roland Martin
*Attorney, Agent, or Firm*—E. O. Palazzo

[57] ABSTRACT

A toner comprised of resin, colorant, and a surface additive mixture of a magnetite and a polyvinylidene fluoride.

42 Claims, No Drawings

TONER COMPOSITIONS

BACKGROUND OF THE INVENTION

The present invention is generally directed to toner and developer compositions, and more specifically, the present invention is directed to positively, or negatively charged toner compositions, or toner particles containing a mixture of a polyvinylidene fluoride, such as KYNAR® 201 available from E.I. DuPont, and a magnetite. With the toners of the present invention, in embodiments thereof a number of advantages are achievable, such as the generation of low density line copies, that is for example, lines with a visual darkness of from about 0.20 to about 0.30, and preferably about 0.27 as measured by a visual darkness standard, darkness being a combination of line density and line width, excellent solid areas, that is wherein the solid area refers to any portion of the document to be copied with dimensions about equal to or greater than about 25×25 millimeters, an image optical density of, for example, from about 1, or from about 1 to about 7 as measured with a Macbeth Model 918 densitometer, substantial toner insensitivity to humidity, especially humidities of from about 20 to about 80 percent, acceptable toner stable triboelectric charging values, such as from about 15 to about 50 microcoulombs per gram as determined, for example, by the known Faraday Cage, and wherein the toners enable the generation of developed images with superior resolution, and excellent developed image intensity. The toner compositions can contain colorants, such as pigment particles comprised of, for example, carbon black, magnetites, or mixtures thereof, thereby providing for the development and generation of black and/or colored images, and in embodiments for use as two component development and single component development wherein a carrier or carrier particles are avoided. The toner and developer compositions of the present invention can be selected for electrophotographic, especially xerographic, imaging and printing processes, including color, digital processes, and multisystems apparatus and machines.

PRIOR ART

Toner compositions containing magnetites therein and additives of silica, and polyvinylidene fluorides are known. Disadvantages of these toners are, for example, low line darkness, that is, the output darkness for a 0.27 darkness input line is less than about 6.5 darkness units and high toner consumption, for example, greater than about 0.037 gram per copy for a 5 percent input area coverage causing, for example, shorter cartridge life, and which disadvantages are minimized or eliminated with the toners and the developers of the present invention.

Toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are each generally present in an amount of from about 1 weight percent by weight to about 5 weight percent by weight, and preferably in an amount of from about 1 weight percent by weight to about 3 weight percent by weight. Several of the aforementioned additives are illustrated in U.S. Pat. Nos. 3,590,000 and 3,900,588, the disclosures of which are totally incorporated herein by reference. Also known are toners containing a mixture of hexamethyidisilazane (HMDZ) and APTES.

Further, toner compositions with charge enhancing additives, which impart a charge to the toner resin, are also known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar disclosures are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin is particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

The appropriate components and processes of the above patents may be selected for the present invention in embodiments thereof.

SUMMARY OF THE INVENTION

Examples of features of the present invention in embodiments thereof include:

It is a feature of the present invention to provide toner and developer compositions with a mixture of certain surface additives, and wherein the toners possess a number of advantages.

In another feature of the present invention there are provided positively charged toner compositions useful for the development of electrostatic latent images.

In another feature of the present invention there are provided positively charged toner compositions.

In another feature of the present invention there are provided toners with certain surface additives and which toners may possess fast admix, for example less then about 15 seconds, as measured by a charge spectrograph.

Also, in another feature of the present invention there are provided certain surface additives that enable a toner with an unimodal charge distribution as measured by a charge spectrograph upon admixing of fresh new toner with aged toner.

Further, in another feature of the present invention there are is provided toner and developer compositions with a mixture of certain surface additives that enable acceptable high stable triboelectric charging characteristics of from about 15 to about 50 microcoulombs per gram, and preferably from about 20 to about 40 microcoulombs per gram.

Moreover, in another feature of the present invention there are provided toner and developer compositions with a mixture of surface additives that enable humidity insensitivity, from about, for example, 20 to about 80 percent relative humidity at temperatures of from about 60° F. to about 80° F. as determined in a relative humidity testing chamber.

In another feature of the present invention there are provided toner and developer compositions with a mixture of certain surface additives that enable positively charged toner compositions with desirable admix properties of from about 1 second to about 60 seconds as determined by the known charge spectrograph, and more preferably less than about 30 seconds.

Additionally in another feature of the present invention there are provided toner compositions that can be extruded at temperatures higher, for example from about 190° C. to about 200° C., than the melting point of the charge enhancing additive selected for the toner thereby enabling, for example, improved imaging copy quality and wherein there is enabled a high enough temperature to melt the charge additive and thus permit excellent dispersion of the charge additive.

Another feature of the present invention resides in the formation of toners with a mixture of certain surface additives which will enable the development of images in electrophotographic imaging apparatuses, which images have substantially no background deposits thereon, are substantially smudge proof or smudge resistant, and therefore are of excellent resolution; and wherein the toners also provide developed images with low density lines and excellent solid areas.

Aspects of the present invention relate to a toner comprised of resin, colorant, and a surface additive mixture of a magnetite and a polyvinylidene fluoride; a toner comprised of resin, colorant, a wax, a charge additive, a wax compatibilizer, and a surface additive mixture of a magnetite and a polyvinylidene fluoride; a developer comprised of toner, and carrier particles; a toner wherein the magnetite is an iron oxide comprised of a mixture of ferrous oxide and ferric oxide; a toner wherein the magnetite is comprised of spherical particles of $Fe_2O_3$, which magnetite may be coated with a silane, such as γ-chloropropyltrimethoxy silane or a titanate like isopropyltridioctyl pyrophosphato titanate; a toner wherein the magnetite is present in an amount of from about 0.5 to about 10 percent; a toner wherein the magnetite is present in an amount of from about 0.5 to about 3 weight percent; a toner wherein the polyvinylidene fluoride is present in an amount of from about 0.5 to about 99, from about 0.5 to about 25, or from about 0.5 to about 10 weight percent; a toner wherein the polyvinylidene fluoride is present in an amount of from about 0.5 to about 3 weight percent; a toner wherein the polyvinylidene fluoride possesses a molecular weight $M_w$ of from about 500,000 to about 600,000, a melting point of from about 158° C. to about 161° C., a specific gravity of from about 1.75 to about 1.76, a melt viscosity of from about 29 to about 33 at 232° C.; a toner wherein the polyvinylidene fluoride possesses a melting point of about 160° C., a specific gravity of about 1.75 to about 1.77, and a toner with KYNAR 700® with a melting point range of about 166° C. to about 170° C., and a specific gravity of about 1.77 to about 1.79; a toner wherein the mixture of the magnetite and the polyvinylidene fluoride is present on the toner surface in an amount of from about 0.05 to about 10 weight percent, and wherein the fluoride possesses a melting point of from about 158° C. to about 161° C.; a toner wherein the mixture of the magnetite and the polyvinylidene fluoride is present on the toner surface in an amount of from about 1 to about 5 weight percent; a toner wherein the charge additive is a quaternary ammonium salt; a toner wherein the charge additive is benzenemethanaminium, N,N,N-tributyl-, salt with 4-hydroxy-1-naphthalenesulfonic acid (1:1); a toner wherein the charge additive is ammonium, dimethyidioctadecyl methyl sulfate, pyridinium, 1-hexadecyl-, chloride, or ammonium, dimethyldioctadecyl methyl sulfate/-bisulfate; a toner wherein the resin is a styrene polymer; a toner wherein the toner further contains surface additives of metal oxides, metal salts, metal salts of fatty acids, or mixtures thereof; a toner composition wherein the colorant is a pigment of carbon black; a toner with a triboelectric charge of from about 15 to about 55, or with a triboelectric charge of from about 25 to about 40; a toner wherein the resin is present in an amount of from about 80 weight percent to about 99 weight percent, and the colorant is present in an amount of from about 15 weight percent to about 1 weight percent; a toner composition with an admix time of from about 1 second to about 60 seconds; a developer comprised of the toner illustrated herein, and coated carrier; a developer with a unimodal charge distribution as measured by a charge spectrograph; a toner wherein the wax is of a molecular weight $M_w$ of from about 1,000 to about 20,000; a developer wherein the carrier is comprised of from about 0.1 percent to about 0.5 percent polyvinylidine fluoropolymer resin coated on an about 60 to an about 80 micron powdered iron core; a toner wherein the polyvinylidene fluoride is of the formula $(C_2F_2H_2)_x$ wherein X represents the number of repeating segments, and more specifically, wherein X is a number of from about 10 to about 1,000; and a toner wherein the compatibilizer is a diblock block of styrene and ethylene/butylene/styrene, a styrene/ethylene/propylene-styrene, a styrene/ethylene/butylene-styrene, or a styrene/butadiene.

Of importance with respect to the present invention in embodiments is the surface additive mixture of a magnetite and a polyvinylidene fluoride and which mixture is selected in various suitable amounts, such as for example, from about 0.05 to about 10 weight percent, and preferably from about 0.5 to about 3 weight percent based, for example, on the weight of all the toner components. The mixture can contain a number of different suitable amounts of each component, for example from about 1 to about 99, and preferably from about 0.5 to about 3 of magnetite in weight percent or parts, and from about 99 to about 1, and preferably from about 0.5 to about 3 weight percent or parts of polyvinylidene fluoride. Examples of polyvinylidene fluorides selected include those that are commercially available, such as KYNAR® 201, KYNAR® 301 available from Elf Atochem, and the like, and examples of magnetites are MAPICO BLACKS available from Laporte Pigments, MAT305K3, and MAT305J1L available from Toda America Inc., other known magnetites, coated magnetites and the like, reference for example U.S. Pat. Nos. 5,482,805; 5,487,841; 4,859,550 and 4,517,268, the disclosures of each patent being totally incorporated herein by reference.

Charge additive examples are as indicated herein, and more specifically, quaternary ammonium salts, such as P51, a quaternary ammonium salt available from Orient Chemicals, sulfonates, sulfates, bisulfates, and other suitable known charge additives, reference for example U.S. Pat. Nos. 5,304,449; 4,904,762; 5,223,368; 5,045,423 and 4,837,157, the disclosures of which are totally incorporated herein by reference, and which additives are each selected in various effective amounts, such as for example, from about 0.1 to about 10, and preferably from about 0.5 to about 2.0 weight percent.

Wax compatibilizers that an be selected for the toners of the present invention are known, reference for example, U.S. Pat. No. 5,229,242, the disclosure of which is totally incorporated herein by reference, and more specifically the Kratons available from Shell Chemical Company, such as Kraton G17726, a diblock of styrene and ethylene/butylene/styrene, and the like and which compatibilizers are selected in various suitable amounts, such as from about 0.5 to about 10 and preferably from about 1 to about 3 weight percent. Moreover, the toners of the present invention can contain waxes like alkylene waxes, such as polypropylene and polyethylene, reference for example U.K. Patent Publication 1,442,835 and U.S. Pat. Nos. 5,023,158; 5,004,666; 4,997,739; 4,988,598; 4,921,771 and 4,917,982, the disclosures of which are totally incorporated herein by reference. Usually the wax is present in the toner in an amount of from about 0.5 to about 10 weight percent.

Yet more specifically, there can be included in the toner compositions of the present invention charge additives as indicated herein in various effective amounts, such as from about 0.5 to about 19, and preferably from about 0.5 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 0.5 weight percent by weight to about 15 weight percent by weight, and preferably in an amount of from about 0.5 weight percent by weight to about 10 weight percent by weight, and wherein the total of all toner components is about 100 percent. The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

The toner compositions of the present invention can be prepared by admixing and heating resin particles such as styrene polymers, polyesters, and similar thermoplastic resins, colorant, wax, especially low, from about 1,000 to about 20,000 $M_w$, molecular weight waxes, compatibilizer, and charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Alpine fluidized bed grinder for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the surface additive mixture and other additives are added by the blending thereof with the toner obtained.

Illustrative examples of suitable toner binders, include toner resins, such as thermoplastic resins like polyamides, polyolefins, styrene acrylates, such as PSB-2733SS obtained from Hercules-Sanyo Inc., and preferably selected in the amount of about 57 weight percent, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded resins, especially reactive extruded polyesters with crosslinking as illustrated in U.S. Pat. No. 5,376,494, the disclosure of which is totally incorporated herein by reference, styrene acrylates, and mixtures thereof. The resin is present in a sufficient, but effective amount, for example, from about 50 to about 90 weight percent. Also, waxes with a molecular weight of from about 1,000 to about 20,000, such as polyethylene, polypropylene, and paraffin waxes, can be included in, or on the toner compositions as fuser roll release agents.

Colorant preferably includes black pigments, black dyes, and mixtures thereof, and which colorants are present in the toner in a variety of amounts, such as for example from about 1 to about 20, and preferably from about 3 to about 12 weight percent. Colorant may include pigments, dyes, mixtures thereof, mixtures of dyes, mixtures of pigments, and the like.

Examples of pigments include Violet Toner VT-8015 (Paul Uhlich); Paliogen Violet 5100 (BASF); Paliogen Violet 5890 (BASF); Permanent Violet VT 2645 (Paul Uhlich); Heliogen Green L8730 (BASF); Argyle Green XP-111-S (Paul Uhlich); Brilliant Green Toner GR 0991 (Paul Uhlich); Lithol Scarlet D3700 (BASF); Toluidine Red (Aldrich); Scarlet for Thermoplast NSD PS PA (Ugine Kuhlmann of Canada); E.D. Toluidine Red (Aldrich); Lithol Rubine Toner (Paul Uhlich); Lithol Scarlet 4440 (BASF); Bon Red C (Dominion Color Company); Royal Brilliant Red RD-8192 (Paul Uhlich); Oracet Pink RF (Ciba-Geigy); Paliogen Red 3871K (BASF); Paliogen Red 3340 (BASF); Lithol Fast Scarlet L4300 (BASF); Heliogen Blue L6900, L7020 (BASF); Heliogen Blue K6902, K6910 (BASF); Heliogen Blue D6840, D7080 (BASF); Sudan Blue OS (BASF); Neopen Blue FF4012 (BASF); PV Fast Blue B2GO1 (American Hoechst); Irgalite Blue BCA (Ciba-Geigy); Paliogen Blue 6470 (BASF); Sudan III (Red Orange), (Matheson, Colemen Bell); Sudan II (Orange), (Matheson, Colemen Bell); Sudan Orange G (Aldrich); Sudan Orange 220 (BASF); Paliogen Orange 3040 (BASF); Ortho Orange OR 2673 (Paul Uhlich); Paliogen Yellow 152,1560 (BASF); Lithol Fast Yellow 0991K (BASF); Paliotol Yellow 1840 (BASF); Novoperm Yellow FGL (Hoechst); Permanent Yellow YE 0305 (Paul Uhlich); Lumogen Yellow D0790 (BASF); Suco-Yellow L1250 (BASF); Suco-Yellow D1355 (BASF); Suco Fast Yellow D1355, D1351 (BASF); Hostaperm Pink E (American Hoechst); Fanal Pink D4830 (BASF); Cinquasia Magenta (Du Pont); Paliogen Black L0084 (BASF); Pigment Black K801 (BASF); and carbon blacks, such as REGAL 330® (Cabot), Carbon Black 5250, Carbon Black 5750 (Columbian Chemical Company).

Dye examples include Pontamine; Food Black 2; Carodirect Turquoise FBL Supra Conc. (Direct Blue 199), available from Carolina Color and Chemical; Special Fast Turquoise 8 GL Liquid (Direct Blue 86), available from Mobay Chemical; Intrabond Liquid Turquoise GLL (Direct Blue 86), available from Crompton and Knowles; Cibracron Brilliant Red 38-A (Reactive Red 4), available from Aldrich Chemical; Drimarene Brilliant Red X-2B (Reactive Red 56), available from Pylam, Inc.; Levafix Brilliant Red E-4B, available from Mobay Chemical; Levafix Brilliant Red E6-BA, available from Mobay Chemical; Procion Red H8B (Reactive Red 31), available from ICI America; Pylam Certified D&C Red #28 (Acid Red 92), available from Pylam; Direct Brill Pink B Ground Crude, available from Crompton and Knowles; Cartasol Yellow GTF Presscake, available from Sandoz, Inc.; Tartrazine Extra Conc. (FD&C Yellow #5, Acid Yellow 23), available from Sandoz, Inc.; Carodirect Yellow RL (Direct Yellow 86), available from Carolina Color and Chemical; Cartasol Yellow GTF Liquid Special 110, available from Sandoz, Inc.; D&C Yellow #10 (Acid Yellow 3), available from Tricon; Yellow Shade 16948, available from Tricon; Basacid Black X34, available from BASF; Carta Black 2GT, available from Sandoz, Inc.; and the like. Particularly preferred are solvent dyes, and within the class of solvent dyes, spirit soluble dyes are preferred because of their compatibility with the vehicles and dye leveling compounds of the present application. Examples of suitable spirit solvent dyes include Neozapon Red 492 (BASF); Orasol Red G (Ciba-Geigy); Direct Brilliant Pink B (Crompton-Knolls); Aizen Spilon Red C-BH (Hodogaya Chemical Company); Kayanol Red 3BL (Nippon Kayaku Company); Levanol Brilliant Red 3BW (Mobay Chemical Company); Levaderm Lemon Yellow (Mobay Chemical Company); Spirit Fast Yellow 3G, Aizen Spilon Yellow C-GNH (Hodogaya Chemical Company); Sirius Supra Yellow GD 167, Cartasol Brilliant Yellow 4GF (Sandoz); Pergasol Yellow CGP (Ciba-Geigy); Orasol Black RLP (Ciba-Geigy); Savinyl Black RLS (Sandoz); Dermacarbon 2GT (Sandoz); Pyrazol Black BG (ICI); Morfast Black Conc. A (Morton-Thiokol); Diaazol Black RN Quad (ICI); Orasol Blue GN (Ciba-Geigy); Savinyl Blue GLS (Sandoz); Luxol Blue MBSN (Morton-Thiokol); Sevron Blue 5GMF (ICI); Basacid Blue 750 (BASF), and the like. Neozapon Black X51 [C.I. Solvent Black; C.I. #12195] (BASF); Sudan Blue 670 [C.I. #61554] (BASF); Sudan Yellow 146 [C.I. #12700] (BASF); Sudan Red 462 [C.I. #26050] (BASF) are preferred.

Developers include the toners illustrated herein and carrier particles. Developer compositions can be prepared by mixing toner with known carrier particles, including coated carriers, such as steel, ferrites, and the like, reference U.S. Pat. Nos. 4,937,166 and 4,935,326, the disclosures of which are totally incorporated herein by reference, for example from about 2 weight percent toner concentration to about 9 weight percent toner concentration. The carriers can include coatings thereon, such as those illustrated in the U.S. Pat. Nos. 4,937,166 and 4,935,326 patents, and other known coatings. There can be selected a single coating polymer, or a mixture of polymers. Additionally, the polymer coating, or coatings may contain conductive components therein, such as carbon black in an amount for example, of from about 10 to about 70 weight percent, and preferably from about 20 to about 50 weight percent.

Imaging methods are also envisioned with the toners and developers of the present invention, reference for example a number of the patents mentioned herein, and U.S. Pat. Nos. 4,265,990; 5,648,539; 5,648,542; 4,585,884; 4,584,253 and 4,563,408, the disclosure of which is totally incorporated herein by reference.

The following Examples are being submitted to further illustrate various pieces of the present invention. These Examples are intended to be illustrative only and are not intended to limit the scope of the present invention. Comparative Examples and data are also submitted.

EXAMPLES

A toner resin can be prepared by a number of suitable methods, such as for example the appropriate patents incorporated herein by reference, and more specifically, by a solution blending of from about 50:50 to about 90:10 parts of two polystyrene-copolyacrylate polymers; a first polystyrene-copolyacrylate resin with a relatively low molecular weight $M_w$ of from about 2,000 to about 6,000 as measured by GPC mixed in solution with a second polystyrene-copolyacrylate resin with a relatively high molecular weight $M_w$ of from about 300,000 to about 500,000 as measured by GPC to form an intimately co-mixed blend of the two polymers. The solvent selected, such as tetrahydrofuran, was subsequently extracted to produce a toner resin with a final low volatile content of less than or equal to about 5,000 ppm.

There was mixed in an ZSK83 extruder with the screw speed at 220 rpm and at a feed rate of 390 kilograms per hour, 847 kilograms of the above generated resin, 60 kilograms of REGAL® 330 carbon black and 8 kilograms of the charge additive P51, a (benzenemethanaminium, N,N,N-tributyl-, salt with 4-hydroxy-1-naphthalenesulfonic acid (1:1). 60 kilograms of Mitsui P200 polypropylene wax, 20 kilograms of the compatibilizer Kraton G1726X, a diblock block of styrene and ethylene/butylene/styrene, and 5 kilograms of Mitsui P800 polyethylene wax. The extruder conditions were 390 kilograms/hour feed rate, a 220 rpm screw rate and with 3 percent water injection. Zones 1 to 3 temperature 80° C., zones 4 to 11 temperature 70° C., zone 12, 120° C. and zone 13, 180° C.

Another version of the extruder conditions were as follows: 550 kilograms/hour feed rate with a 420 rpm screw rate with 3 percent water injection. Zones 1 to 3 temperature 80° C., zones 4 to 11 temperature 70° C., zone 12, 120° C. and zone 13, 180° C. to achieve a toner melt temperature of 200° C. One aspect of the processing is that at 175° F. the P51 charge control additive did not melt whereas at 200° F. it did. The melting point of P51 is about 182° C. to about 187° C. Thereafter the toner exiting is cooled in water to about room temperature, about 25° C. The toner is then pulverized and classified to remove toner particles with a volume average diameter of less than 5 microns, resulting in a toner of about 84.7 percent styrene acrylate resin and 6 percent of carbon black.

Subsequently, the above toner was mixed with the magnetite Mat305K3 about 1 weight percent and about 1 weight percent of polyvinylidene fluoride, KYNAR® 201. More specifically, 135 kilograms of the above toner together with 10 kilograms of magnetite and 10 kilograms of KYNAR® 201 were placed in a 600 Liter Henschel Blender and blended for 10 minutes at 1,100 RPM.

A developer was prepared by mixing 8 parts of the above blended toner with 100 parts of a carrier, preferably a Vertex Type 29 carrier, available from Vertex Corporation, which contains 0.1 percent to 0.5 percent polyvinylidine fluoropolymer resin coated on a 70 micron powdered iron core obtained from Quebec Metal Products. The toner (1) existed the extruder at 175° C., the toner yield was, for example, from 90 to 98 percent, the toner tribo was −19.4 microcoulombs per gram as determined in the known Faraday Cage, and which toner is especially useful for the Xerox Corporation 5009 machines. The above toner with surface additives of magnetite and polyvinylidene fluoride were prepared by the above extrusion process except that the toner (2) existed the extruder at 200° C., the extruder screw rpm was 420 and the feed rate was 550 kilograms per hour, and there resulted a toner with a tribo charge of −22.6 microcoulombs per gram.

When the above base (1) toner (base refers to no additives of magnetite and polyvinylidene fluoride) was blended with 0.1 percent $TiO_2$ and 0.1 percent PMMA (polymethyl methacrylate) with a particle size of 0.26 to 0.5 micron, a molecular weight of 200,000 to 550,000, and a glass transition temperature of about 120° C. to about 140° C., the extruder temperature was 200° C. The toner (3) with $TiO_2$ and PMMA tribo was −19.4 microcoulombs per gram.

Toner (1) above with magnetite and PMMA was tested in the Xerox Corporation machines 5310, Ser. No. 047450, and 5310, Ser. No. 000582, each of these machines containing a toner cartridge. These tests were conducted at 70° F. and 50 percent RH (relative humidity). The cartridge life was 4,592 and 4,631 copies, respectively.

Toner (2) above was tested as above in the Xerox 5310, Ser. No. 106276. The cartridge life was 4,966 copies.

Toner (3) was tested as above in the 5310, Ser. No. 047450, and 5310, Ser. No. 000582, and the cartridge life was 3,756 and 3,890 copies, respectively.

Subsequently, toner (1) above was tested in the 5310 at 60° F. and 15 percent RH for part of the test, followed by testing in sequence at 80° F. and 80 percent RH. The toner cartridge life was 3,990 copies. When toner (2) was tested in the same manner, the cartridge life was 4,966 copies.

The above calculated cartridge lifes were based on the amount of toner consumed and the condition of the cartridge.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner comprised of resin, colorant, and a surface additive mixture of a magnetite and a polyvinylidene fluoride.

2. A toner comprised of resin, colorant, a wax, a charge additive, a wax compatibilizer, and a surface additive mixture of a magnetite and a polyvinylidene fluoride.

3. A developer comprised of the toner of claim 1 and carrier.

4. A toner in accordance with claim 2 wherein the magnetite is an iron oxide comprised of a mixture of ferrous oxide and ferric oxide.

5. A toner in accordance with claim 2 wherein the magnetite is comprised of spherical particles of $Fe_2O_3$.

6. A toner in accordance with claim 2 wherein the magnetite is present in an amount of from about 0.5 to about 10 percent.

7. A toner in accordance with claim 2 wherein the magnetite is present in an amount of from about 0.5 to about 3 weight percent.

8. A toner in accordance with claim 2 wherein the polyvinylidene fluoride is present in an amount of from about 0.5 to about 99 weight percent.

9. A toner in accordance with claim 2 wherein the polyvinylidene fluoride is present in an amount of from about 0.5 to about 3 weight percent.

10. A toner in accordance with claim 2 wherein the polyvinylidene fluoride possesses a molecular weight $M_w$ of from about 500,000 to about 600,000, a melting point of from about 158° C. to about 161° C., a specific gravity of from about 1.75 to about 1.76, and a melt viscosity of from about 29 to about 33 at 232° C. of 100 $sec^{-1}$.

11. A toner in accordance with claim 2 wherein the polyvinylidene fluoride possesses a melting point of about 160° C., and a specific gravity of about 1.75 to about 1.77.

12. A toner in accordance with claim 2 wherein the mixture of said magnetite and said polyvinylidene fluoride is present on the toner surface in an amount of from about 0.05 to about 10 weight percent, and wherein said fluoride optionally possesses a melting point of from about 158° C. to about 161° C.

13. A toner in accordance with claim 2 wherein the mixture of said magnetite and said polyvinylidene fluoride is present on the toner surface in an amount of from about 1 to about 5 weight percent.

14. A toner in accordance with claim 2 wherein the charge additive is a quaternary ammonium salt.

15. A toner in accordance with claim 2 wherein the charge additive is benzenemethanaminium, N,N,N-tributyl-, salt with 4-hydroxy-1-naphthalenesulfonic acid (1:1).

16. A toner in accordance with claim 2 wherein the charge additive is ammonium, dimethyldioctadecyl methyl sulfate; pyridinium, 1-hexadecyl-, chloride; or ammonium, dimethyldioctadecyl methyl sulfate/bisulfate.

17. A toner in accordance with claim 2 wherein the resin is a styrene polymer.

18. A toner in accordance with claim 2 wherein the toner further contains surface additives of metal oxides, metal salts, metal salts of fatty acids, or mixtures thereof.

19. A toner composition in accordance with claim 2 wherein the colorant is a pigment of carbon black.

20. A toner in accordance with claim 1 with a triboelectric charge of from about 15 to about 55, or with a triboelectric charge of from about 25 to about 40.

21. A toner in accordance with claim 1 wherein the resin is present in an amount of from about 80 weight percent to about 99 weight percent, and the colorant is present in an amount of from about 15 weight percent to about 1 weight percent.

22. A toner composition in accordance with claim 2 with an admix time of from about 1 second to about 60 seconds.

23. A toner in accordance with claim 1 wherein the wax is of a molecular weight $M_w$, of from about 1,000 to about 20,000.

24. A developer comprised of the toner of claim 2 and carrier.

25. A developer in accordance with claim 24 with a unimodal charge distribution as measured by a charge spectrograph.

26. A developer in accordance with claim 24 wherein the carrier is comprised of from about 0.1 percent to about 0.5 percent by weight polyvinylidine fluoropolymer resin coated on from about 60 to about 80 micron diameter powdered carrier iron core.

27. A toner in accordance with claim 1 wherein the polyvinylidene fluoride is of the formula $(C_2F_2H_2)_x$ wherein X represents the number of repeating segments.

28. A toner in accordance with claim 2 wherein said compatibilizer is a diblock of styrene and ethylene/butylene/styrene, a styrene/ethylene/propylene-styrene, a styrene/ethylene/butylene-styrene, or a styrene/butadiene.

29. A toner in accordance with claim 5 wherein the magnetite contains a coating.

30. A toner in accordance with claim 29 wherein the coating is a silane.

31. A toner in accordance with claim 29 wherein the coating is γ-haloalkylalkoxy silane.

32. A toner in accordance with claim 29 wherein the coating is γ-chloropropyltrimethoxy silane.

33. A toner in accordance with claim 29 wherein the coating is isopropyltridioctyl pyrophosphato phosphate.

34. A toner in accordance with claim 5 wherein said magnetite is of a size diameter of from about 0.1 to about 0.5 micron.

35. A toner in accordance with claim 5 wherein said magnetite is of a size diameter of about 0.23 micron.

36. A toner in accordance with claim 1 wherein said polyvinylidene fluoride possesses a melting point of from about 165° C. to about 170° C. and a specific gravity of from about 1.77 to about 1.79.

37. A developer in accordance with claim 24 wherein said carrier is comprised of a core of a ferrite.

38. A developer in accordance with claim 24 wherein said carrier is a strontium ferrite.

39. A developer in accordance with claim 24 wherein said carrier contains a polymer coating.

40. A toner in accordance with claim 2 wherein said wax is an alkylene.

41. A toner in accordance with claim 2 wherein said wax is a polyethylene, a polypropylene, or mixtures thereof.

42. A toner in accordance with claim 1 wherein said resin is comprised of a mixture of resins.

* * * * *